United States Patent [19]

Briggs, Sr.

[11] Patent Number: 4,974,362

[45] Date of Patent: Dec. 4, 1990

[54] DECORATIVE SHUTTER

[75] Inventor: Kenneth W. Briggs, Sr., Rice, Tex.

[73] Assignee: Rushman Draperies, Inc., Dallas, Tex.

[21] Appl. No.: 391,861

[22] Filed: Aug. 10, 1989

Related U.S. Application Data

[63] Continuation-in-part of Ser. No. 58,146, Jun. 4, 1987, Pat. No. 4,887,391.

[51] Int. Cl.[5] ..... E06B 7/086

[52] U.S. Cl. ..... 49/90; 49/74

[58] Field of Search ..... 49/90, 74, 64, 51, 88, 49/87, 86; 98/121.2

[56] References Cited

U.S. PATENT DOCUMENTS

| | | | |
|---|---|---|---|
| 118,454 | 8/1871 | Hobbs et al. | 49/90 |
| 125,887 | 4/1872 | Fowler | 49/90 X |
| 169,644 | 11/1875 | Johnston et al. | 49/90 X |
| 207,026 | 8/1878 | Fuller | 49/90 X |
| 213,343 | 3/1879 | Morstatt | 49/88 |
| 345,689 | 7/1886 | Hayes | 98/121.2 X |
| 360,058 | 3/1887 | Snell et al. | 49/90 X |
| 368,808 | 8/1887 | Cahill | 49/88 |
| 3,129,471 | 4/1964 | Johnson et al. | 49/64 |
| 3,153,819 | 10/1964 | Bond | 49/64 |
| 3,292,309 | 12/1966 | Horner | 49/64 |

*Primary Examiner*—Philip C. Kannan

*Attorney, Agent, or Firm*—Ross, Howison, Clapp & Korn

[57] ABSTRACT

A window shutter having pivoting louvers mounted in a rectangular shutter frame and linked together for common pivotal movement by a ganging bar mounted adjacent the ends of the louvers. The bar has pins extending into the end of each louver spaced from the pivot point of the louver. The louvers are retained in positions selected by the user without imposing significant axial force on the louvers by means of a pair of magnets mounted in the side of the frame adjacent the ganging bar for retaining the bar in the selected position. The louvers are pivoted about an asymmetric axis positioned so that the louvers never extend beyond the rear face of the frame, while extending substantially beyond the front faces of the frame in their horizontal orientation.

4 Claims, 1 Drawing Sheet

16
12
4
24
10
14
18
24
20
24
22
4

10
24
18
24

10
18

12
16
18
30
40
42
44
14
30
26
34
46
28
20
32
24
34
36

24
34
28
44
26
40
50
24
50
24
44
26
34

DECORATIVE SHUTTER

IDENTIFICATION OF RELATED APPLICATION

This application is a continuation-in-part of U.S. patent application Ser. No. 058,146, filed June 4, 1987 now U.S. Pat. No. 4,887,391.

BACKGROUND ART

Decorative shutters employing pivoting louvers for selection of the amount of light admitted thereby are well known in the art. Typical decorative shutters have movable louvers ganged together for common movement by a rod or stick mounted down the center of the shutter assembly and secured by means of staples or other fasteners to the edge of each louver.

Each louver is mounted symmetrically in such shutters so that it is roughly balanced. When a relatively wide louver is desired as in the popular "plantation" shutters, this results in extension of the louvers outside the planes of both faces of the shutters when the louvers are in a horizontal position.

Typical examples of the arrangement of shutter assemblies wherein louvers are ganged together by a central stick or rod are shown in U.S. Pat. Nos. 2,718,485 and 2,761,185.

SUMMARY OF THE INVENTION

In accordance with the invention, there is provided a window shutter assembly comprising a frame having a rectangular opening between inwardly facing first and second side faces and a plurality of spaced elongate louvers extending between the side faces, each mounted for pivotal movement with respect to the frame about a horizontal axis. Ganging means which link the plurality of louvers for common pivotal movement are mounted adjacent one of the side faces. Position retaining means associated with the ganging means and located adjacent the end of the louvers hold the louvers in the pivotal orientation to which the user sets them. In a specific embodiment, the position retaining means impose substantially no axial force on the louvers.

In a further aspect of the invention, the louvers and their points of pivot are arranged so that the axis about which each louver pivots is spaced at least as far from the rear face of the frame as the distance from the axis to the rear edge of the louver so that the louvers never extend in their pivotal travel beyond the plane of the rear face of the frame.

In a specific aspect of the invention, ganging of the louvers for common pivotal movement is accomplished by means of a thin ganging bar positioned slidably against one of the side faces of the rectangular frame which is provided with a plurality of upstanding ganging pins, each of which extends horizontally into the end of the louver at a point spaced from the axis of pivot of the louvers. Retaining means are provided for the ganging bar by one or more magnets affixed in the side face of the frame adjacent the ganging bar for retaining the ganging bar in any selected position.

In accordance with the manufacturing method of this invention, the frame is formed into its completed state and a selected finish is applied thereto separately from the louvers which are also finished separately. The louvers are then mounted in the frame while simultaneously installing ganging means adjacent the ends of the louvers.

DETAILED DESCRIPTION

Figure 1:
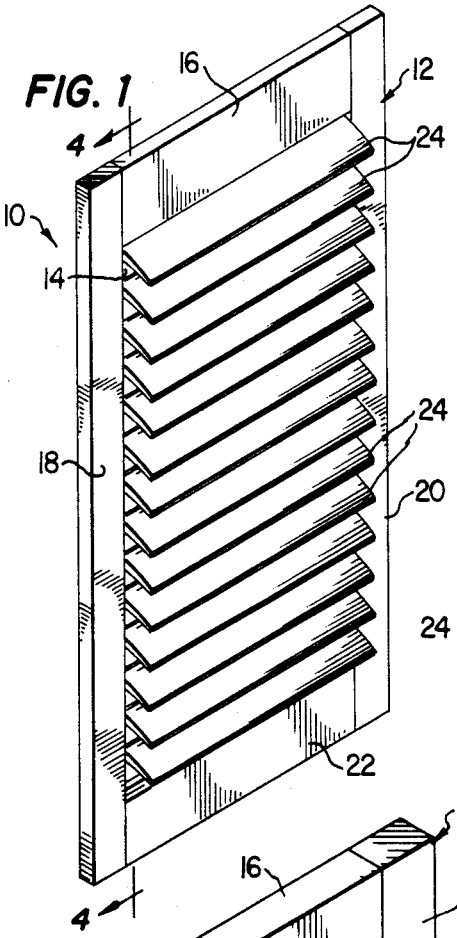
FIG. 1 is a front perspective view of a window shutter constructed in accordance with the invention.
Figure 2:
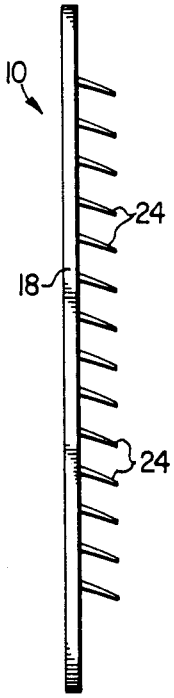
FIG. 2 is a side view of the shutter depicted in FIG. 1, with the louvers open.
Figure 3:
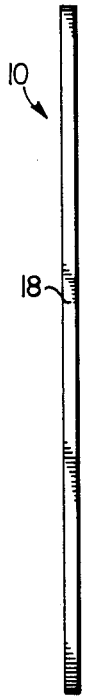
FIG. 3 is a side view similar to FIG. 2 with the louvers closed.
Figure 5:
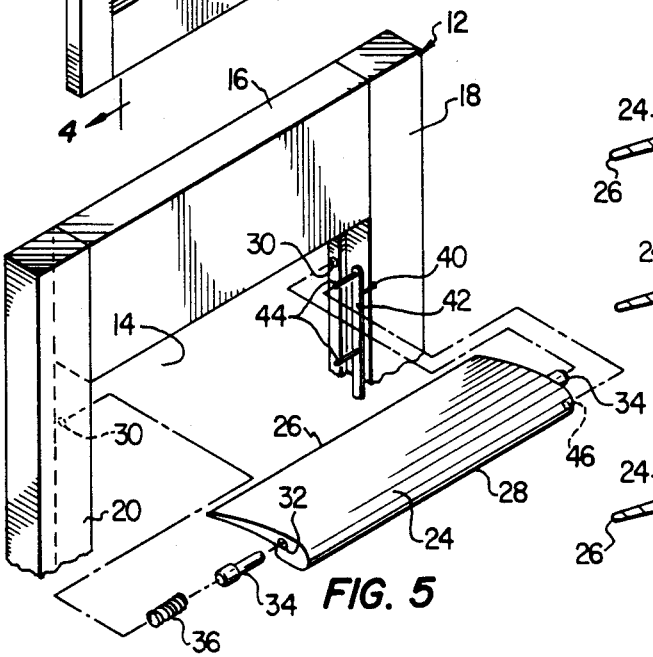
FIG. 5 is a partial rear perspective of the shutters of FIG. 1 with the parts exploded to illustrate the elements combined in accordance with the method of manufacture of the invention.

A shutter assembly 10 constructed in accordance with the invention is depicted in the drawings. The shutter 10 utilizes a frame 12, preferably formed from wood, to form a rectangular opening 14. Frame 12 is formed by joining top panel 16, left panel 18, right 20 and bottom panel 22. A plurality of louvers 24 span rectangular opening 14 between the inward side faces of panels 18 and 20. Each louver 24 has a leading edge 26 and a trailing edge 28.

Side panels 18 and 20 are provided with a pair of horizontally aligned mounting holes 30 for each louver 24. The louvers 24 are provided with mounting holes 32 near the trailing edge 28 for receiving conventional nylon mounting pins 34 which snugly engage the louver holes 32 to position the louver 34 horizontally by the reception of pins 34 in frame holes 30. A mounting spring 36 is provided in between pin 34 and mounting hole 30 adjacent side panel 20, so that the pins 34 at that end may be depressed to accomplish insertion of the louvers 24 into the frame 12. Spring 36 is compressible so that the adjacent pin 34 may be depressed away from louver 24. Once the louvers 24 are in position, springs 36 are no longer in compression, and exert substantially no axial force in the completed assembly 10. The holes 32 in the ends of louver 24 are positioned so that the distance from holes 32 to the trailing edge 28 of the louvers is less than the horizontal distance from frame mounting holes 30 to the back face of frame 12.

A ganging bar 40 has a flat web portion 42 and a series of protruding pins 44, and is mounted flat with the inward side face of frame panel 18, extending the vertical length of the opening 14. The ends of louvers 24 adjacent side panel member 18 are each provided with a second hole 46 for receiving the ganging bar pins 44, which holes 46 are spaced from the axis of frame mounting holes 30.

A pair of magnets 50 are mounted flush with the inwardly facing side face of panel 18 adjacent the ganging bar 40.

The assembly is preferably produced by joining panels 16, 18, 20 and 22 to form frame 12. Frame 12 may then be finished by painting or applying other coating materials. Louvers 24 are likewise finished by paining in any selected color or series of colors prior to mounting in frame 12. Following the formation in prefinishing steps of each of the frame 12 and louvers 24, the louvers may be simultaneously mounted with ganging bar 40 into the operative position depicted.

Figure 4:
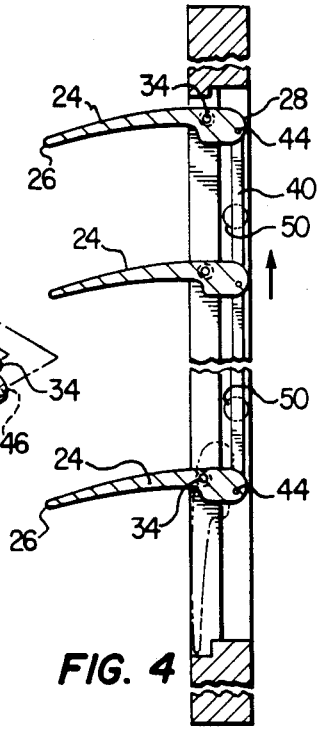
FIG. 4 is a sectional view taken along the line 4—4 in FIG. 4.

In operation, the louvers may be rotated on their pivot pins 34 by smooth and simple manual action applied to a single louver 24. The ganging bar 40 causes all louvers to move in common and substantially parallel relationship. Throughout their entire pivotal movement, louvers 24 do not extend so far rearwardly that their trailing edges 28 extend beyond the rear face of the frame 12, as shown in FIG. 4. Once the user has moved the louvers 24 to a selected position, magnets 50 acting upon ganging bar 40 serve to retain the preferred position without placing axial stresses on the louvers 24.

As will be seen from the foregoing description and drawings, the resulting shutter assembly is one with substantial advantages over presently available shutters. The ganging bar is essentially flush at the side of the frame, so that it does not interfere with sightliness, or with cleaning or painting the shutter assembly 10. The assembly procedure is simplified and made less expensive. A smooth operating shutter is provided without the necessity of separately securing fasteners to the shutter louvers to a ganging rod or stick. Because the components are preformed and prefinished prior to assembly, the louvers may be finished in any selected manner desired by the user. For example, the louvers may actually vary in color one from the other, so that spectrums of color may be produced. As one example, a common color may be shaded in intensity or hue as one proceeds from louver to louver, accomplishing a pleasing aesthetic effect, which would not be possible using conventional shutter assembly manufacturing techniques.

The louvers are mounted in the frame in such a way that the trailing edges of the louvers never extend beyond the rear face of the frame, simplifying installation of the shutter in many instances. This aspect of the invention may be employed in a shutter lacking the magnetic retention system described above. While such a modified embodiment does not enjoy all of the advantages described in conjunction with the embodiment described in the drawings, it has substantial advantages over conventional shutters.

Although specific embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention.

I claim:

1. A flush-mountable decorative louvered shutter comprising:

(a) a frame having a rectangular opening between inwardly facing first and second side faces and having front and rear faces surrounding the opening perpendicular to the side faces;

(b) a plurality of spaced elongate rigid louvers, each louver:

(i) having a solid profile between front and rear edges, and (ii) extending substantially the entire distance between the side faces, and (iii) having a width measured from front edge to rear edge which is substantially larger than the thickness of the frame between front and rear faces;

(c) a pair of pivot pins connecting the side faces and the ends of each louver, each pair being operatively connected to one and only one louver, and each being spaced from the louver rear edge and from the louver front edge for pivoting movement of the louver about a horizontal asymmetric axis, said axis;

(i) being closer to the louver rear edge than the louver front edge; and (ii) being spaced at least as far from the rear face of the frame as the distance from the axis to the rear edge of the louver, while being spaced from the front face of the frame by a distance which is substantially less than the distance from the axis to the front edge of the louver whereby no portion of the louvers extends rearwardly of the rear face of the frame at any orientation of the louvers;

(d) ganging means for providing common pivotal movement of the louvers such that the louvers never extend in their pivotal travel beyond the plane of the rear face of the frame, but do extend substantially beyond the plane of the front face of the frame in their generally horizontal orientation; and (e) a louver position retainer, whereby no part of the shutter extends rearwardly of the rear face of the frame, so that the shutter may be mounted with its rear face flush to the rearwardly surrounding environment, and whereby the louvers may be held and set in any angular orientation which a user selects.

2. The shutter of claim 1, wherein the solid profile of each louver converges toward the front edge of the louver, and a thickened portion of the profile is located near the rear edge of the louver.

3. The shutter of claim 2, wherein the pivot pins associated with each louver are located in said thickened portion.

4. The shutter of claim 1, wherein the pivot pins are mounted closer to the rear face of the frame than to the front face.

* * * * *